US010006112B2

(12) United States Patent
Na et al.

(10) Patent No.: US 10,006,112 B2
(45) Date of Patent: Jun. 26, 2018

(54) FLUXING METHOD TO REVERSE THE ADVERSE EFFECTS OF ALUMINUM IMPURITIES IN NICKEL-BASED GLASS-FORMING ALLOYS

(71) Applicant: Glassimetal Technology, Inc., Pasadena, CA (US)

(72) Inventors: Jong Hyun Na, Pasadena, CA (US); Michael Floyd, Pasadena, CA (US); Danielle Duggins, Garden Grove, CA (US); David S. Lee, Wenham, MA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 843 days.

(21) Appl. No.: 14/457,821

(22) Filed: Aug. 12, 2014

(65) Prior Publication Data

US 2015/0050181 A1 Feb. 19, 2015

Related U.S. Application Data

(60) Provisional application No. 61/866,615, filed on Aug. 16, 2013.

(51) Int. Cl.

| | |
|---|---|
| ***C22C 45/04*** | (2006.01) |
| ***C22B 23/06*** | (2006.01) |
| ***C22C 1/00*** | (2006.01) |
| ***C22C 19/00*** | (2006.01) |
| ***C22C 19/03*** | (2006.01) |
| ***C22C 19/05*** | (2006.01) |
| *C22F 1/10* | (2006.01) |

(52) U.S. Cl.

CPC ..... *C22C 45/04* (2013.01); *C22B 23/06* (2013.01); *C22C 1/002* (2013.01); *C22C 19/005* (2013.01); *C22C 19/03* (2013.01); *C22C 19/05* (2013.01); *C22C 19/057* (2013.01); *C22F 1/10* (2013.01)

(58) Field of Classification Search

None

See application file for complete search history.

(56) References Cited

U.S. PATENT DOCUMENTS 3,809,547 A * 5/1974 Lewis et al. ..... C21C 5/52 420/121

4,175,950 A * 11/1979 Linares ..... C22B 9/10 148/403

(Continued)

OTHER PUBLICATIONS

ASM Handbook, vol. 2: Properties and Selection: Nonferrous Alloys and Specia-Purpose Materials, "Preparation and Characterization of Pure Metals", ASM International, 1990, pp. 1093-1097.*

(Continued)

*Primary Examiner* — George Wyszomierski

(74) *Attorney, Agent, or Firm* — Polsinelli PC

(57) ABSTRACT

A fluxing method is disclosed by which the melt of aluminum-contaminated Ni-based glass-forming alloys is fluxed using a fluxing agent based on boron and oxygen in order to reverse the adverse effects of aluminum impurities on the glass-forming ability and toughness.

18 Claims, 3 Drawing Sheets

(56) References Cited

U.S. PATENT DOCUMENTS

| | | | | |
|---|---|---|---|---|
| 4,773,930 | A * | 9/1988 | Hillis | C22B 26/22 75/601 |
| 5,797,443 | A | 8/1998 | Lin et al. | |
| 5,851,262 | A * | 12/1998 | Mukai | C21C 5/5241 75/10.1 |
| 7,101,413 | B1 * | 9/2006 | Vorndran | C21C 7/0056 75/304 |
| 7,947,134 | B2 * | 5/2011 | Lohwongwatana | C22C 45/00 148/522 |
| 9,534,283 | B2 | 1/2017 | Na et al. | |
| 2006/0157164 | A1 | 7/2006 | Johnson et al. | |
| 2010/0230012 | A1 | 9/2010 | Demetriou et al. | |
| 2013/0048152 | A1 | 2/2013 | Na et al. | |
| 2014/0076467 | A1 | 3/2014 | Na et al. | |
| 2014/0096874 | A1 | 4/2014 | Weber | |
| 2014/0116579 | A1 | 5/2014 | Na et al. | |
| 2014/0130945 | A1 | 5/2014 | Na et al. | |
| 2014/0190593 | A1 * | 7/2014 | Na | C22F 1/10 148/538 |
| 2014/0202596 | A1 | 7/2014 | Na et al. | |

OTHER PUBLICATIONS

Murakami (Editor), Stress Intensity Factors Handbook, vol. 2, Oxford: Pergamon Press, 1987, 4 pages.
U.S. Appl. No. 14/565,205, filed Dec. 9, 2014, Na et al.
U.S. Appl. No. 14/565,211, filed Dec. 9, 2014, Na et al.

* cited by examiner

FLUXING METHOD TO REVERSE THE ADVERSE EFFECTS OF ALUMINUM IMPURITIES IN NICKEL-BASED GLASS-FORMING ALLOYS

CROSS-REFERENCE TO RELATED APPLICATIONS

The present application claims the benefit of U.S. Provisional Patent Application No. 61/866,615, entitled "A Fluxing Method to Reverse the Adverse Effects of Aluminum Impurities in Nickel-Based Glass-Forming Alloys," filed on Aug. 16, 2013, which is incorporated herein by reference in its entirety.

FIELD

The present disclosure relates to a method of fluxing the melt of aluminum-contaminated Ni-based glass-forming alloys to reverse the adverse effects of aluminum impurities on the glass-forming ability and the toughness of these alloys.

BACKGROUND

Raw elements that are widely used in ferrous and nickel based alloys, such as Fe, Ni, Cr, etc. are typically refined using an aluminothermic reaction, where aluminum is used as a reducing agent at high temperature. For example, during the aluminothermic reaction, aluminum reacts with iron oxide to form aluminum oxide and iron. Consequently, aluminum is a fairly common impurity in such elements, as well as in ferrous- and nickel-based alloys that contain such elements. Typically, the aluminum impurities can combine with oxygen as well as other impurities to form alumina-based inclusions that can have adverse effects on the properties of metal alloys.

Among the mechanical properties, the property most severely affected is toughness. In the specific case where the metal alloy is a glass former, the glass-forming ability of the alloy could also be severely degraded by the presence of such alumina-based inclusions. It would be of great technological interest to develop processes capable of reducing aluminum from these alloys to reverse its adverse effects and obtain similar properties as in the "high purity state" of the alloys.

BRIEF SUMMARY

The disclosure is directed to a method of fluxing a Ni-based glass-forming alloy that contains an initial aluminum impurity, comprising (1) heating the Ni-based glass-forming alloy with a fluxing agent based on boron and oxygen to a fluxing temperature that is at least 100° C. above the liquidus temperature of the alloy; (2) allowing the alloy melt and the fluxing agent melt to interact while in contact at the fluxing temperature; and (3) cooling the two melts to room temperature to form fluxed alloy with a final aluminum impurity lower than the initial aluminum impurity.

In another embodiment, the fluxed alloy has critical rod diameter that is at least 70% of the critical rod diameter of the alloy in the high purity state.

In another embodiment, the fluxed alloy has critical rod diameter that is at least 80% of the critical rod diameter of the alloy in the high purity state.

In another embodiment, the fluxed alloy has critical rod diameter that is at least 90% of the critical rod diameter of the alloy in the high purity state.

In another embodiment, a metallic glass formed from the fluxed alloy has notch toughness that is at least 70% of the notch toughness of the metallic glass formed from the alloy in the high purity state.

In another embodiment, a metallic glass formed from the fluxed alloy has notch toughness that is at least 80% of the notch toughness of the metallic glass formed from the alloy in the high purity state.

In another embodiment, a metallic glass formed from the fluxed alloy has notch toughness that is at least 90% of the notch toughness of the metallic glass formed from the alloy in the high purity state.

In another embodiment, the fluxing agent is boron oxide ($B_2O_3$).

In another embodiment, the fluxing agent is boric acid ($H_3BO_3$).

In yet another embodiment, the fluxing agent has purity of at least 98%.

In yet another embodiment, cooling of the alloy melt is sufficiently fast such that the alloy solidifies in an amorphous phase.

In yet another embodiment, the initial aluminum impurity has a weight fraction ranging between 100 ppm and 10000 ppm.

In yet another embodiment, the final aluminum impurity has a weight fraction of less than 100 ppm.

In yet another embodiment, the final aluminum impurity has a weight fraction of less than 50 ppm.

In yet another embodiment, the final aluminum impurity has a weight fraction of less than 10 ppm.

In yet another embodiment, the fluxing process is performed in an inert atmosphere.

In yet another embodiment, the fluxing temperature is at least 1100° C.

In yet another embodiment, the fluxing temperature is at least 1200° C.

In another embodiment, the two melts are allowed to interact at the fluxing temperature for at least 500 s.

In yet another embodiment, the two melts are allowed to interact at the fluxing temperature for at least 1500 s.

In yet another embodiment, the disclosure is directed to metallic glass articles produced using a Ni-based alloy that originally contained an Al impurity with an atomic fraction ranging between 100 ppm and 10000 ppm and that has been fluxed according to the present method, where the metallic glass articles formed from the fluxed alloy have cross sections about as thick as metallic glass articles produced with a Ni-based alloy in the high purity state.

In yet another embodiment, the disclosure is directed to metallic glass articles produced using an alloy that originally contained an Al impurity with an atomic fraction ranging between 100 ppm and 10000 ppm and that has been fluxed according to the present method, where the metallic glass articles formed from the fluxed alloy have a notch toughness about as high as metallic glass articles produced with a Ni-based alloy in the high purity state.

In yet another embodiment, metallic glass articles produced using an alloy fluxed according to the present method having a cross section at least 0.5 mm thick are capable of undergoing macroscopic plastic deformation without fracturing catastrophically under a bending load.

In one aspect, the Ni-based alloy has a composition according to the following formula (subscripts denote atomic percent):

$$Ni_{100-a-b}X_aY_b \quad (1)$$

where:

X is Cr, Mo, Mn, Nb, Ta, Fe or combinations thereof

Y is P, B, Si, or combinations thereof a is between 5 and 25, and b is between 15 and 25

In various aspects, up to 25 at % of Ni is can be substituted by Co.

In another aspect, up to 15 at % of Ni is can be substituted by Fe.

In another aspect, up to 5 at % of Ni is can be substituted by Cu.

In yet another embodiment, a is between 5 and 15 at % and b is between 19 and 23 at %.

In another aspect, the Ni-based alloy has a composition according to the following formula (subscripts denote atomic percent):

$$Ni_{(100-a-b-c-d)}Mn_aX_bP_cB_d \quad (2)$$

where:

a is up to 15, b is between 0.5 and 10, c is between 12 and 21, and d is between 1 and 6, a+b is between 5 and 25, c+d is between 15 and 25, and wherein X is at least one of Nb and Ta.

In another aspect, the Ni-based alloy has a composition according to the following formula (subscripts denote atomic percent):

$$Ni_{(100-a-b-c-d)}Mn_aNb_bP_cB_d \quad (3)$$

where:

a is up to 8, b is between 1 and 5, c is between 15 and 18, d is between 1 and 5, a+b is between 5 and 13, and c+d is between 16 and 23.

In another aspect, the Ni-based alloy has a composition according to the following formula (subscripts denote atomic percent):

$$Ni_{(100-a-b-c)}Mn_aX_bP_{c-d}B_d \quad (4)$$

where:

a is between 0.5 and 10 b is up to 15 c is between 14 and 24 d is between 1 and 8 wherein X can be Cr and/or Mo.

In another aspect, the Ni-based alloy has a composition according to the following formula (subscripts denote atomic percent):

$$Ni_{(100-a-b1-b2-c-c1)}Mn_aCr_{b1}Mo_{b2}P_cB_d \quad (5)$$

where:

a is between 1 and 5 b1 is between 4 and 11 b2 is up to 3 c is between 15 and 19 d is between 1 and 5.

In another aspect, the Ni-based alloy has a composition according to the following formula (subscripts denote atomic percent):

$$Ni_{(100-a-b-c-d)}Cr_aNb_bP_cB_d \quad (6)$$

where:

a ranges from 2.5 to 15, b ranges from 1 to 5.5, c ranges from 14.5 to 18.5, and d ranges from 1.5 to 6.5, In another aspect, the Ni-based alloy has a composition according to the following formula (subscripts denote atomic percent):

$$Ni_{(100-a-b-c-d)}Cr_aNb_bP_cB_d \quad (7)$$

where:

a ranges from 3 to 13, b is determined by x−y*a, where x ranges from 3.8 to 4.2 and y ranges from 0.11 to 0.14, c ranges from 16.25 to 17, d ranges from 2.75 to 3.5, a+b is between 6.91 to 17.34, and c+d is between 19 to 20.5.

In another aspect, the Ni-based alloy has a composition according to the following formula (subscripts denote atomic percent):

$$Ni_{(100-a-b-c-d)}Cr_aNb_bP_cB_d \quad (8)$$

where:

a ranges from 7 to 11, b ranges from 1 to 3.25, c ranges from 13 to 16, d ranges from 3 to 6.5, a+b is between 8 to 14.25, and c+d is between 16 to 22.5.

In another aspect, the Ni-based alloy has a composition according to the following formula (subscripts denote atomic percent):

$$Ni_{(100-a-b-c-d)}Cr_aTa_bP_cB_d \quad (9)$$

where:

a is between 3 and 11, b is between 1.75 and 4, c is between 14 and 17.5, and d is between 2.5 and 5.

$$Ni_{(100-a-b-c)}Mn_aX_bP_{c-d}Si_d \quad (10)$$

where:

a is between 0.5 and 10, b is up to 15, c is between 16 and 24, d is between 0.25 and 5, a+b is between 5 and 25, c+d is between 16.25 and 29, and wherein X can be at least one of Cr, Mo, Nb, Ta.

In yet another aspect, the Ni-based alloy has a composition according to the following formula (subscripts denote atomic percent):

$$Ni_{(100-a-b-c)}Mn_aX_bP_cSi_d \quad (11)$$

where:

a is between 0.25 and 12 b is up to 15 c is between 14 and 22 d is between 0.25 and 5 wherein X can be at least one of Cr, Mo, Nb, Ta.

In yet another aspect, the Ni-based alloy has a composition according to the following formula (subscripts denote atomic percent):

$$Ni_{(100-a-b-c)}Fe_aSi_bB_c \quad (12)$$

where:
a is between 5 and 25,
b is between 10 and 14,
c is between 9 and 13, and
b+c is between 19 and 25.

In yet another aspect, the Ni-based alloy has a composition according to the following formula (subscripts denote atomic percent):

$$Ni_{(100-a-b-c)}Fe_aSi_bB_cP_d \quad (13)$$

where:
a is between 5 and 25,
b is between 7 and 10,
c is between 7 and 10, and
d is up to 8.

In yet another aspect, the Ni-based alloy has a composition according to the following formula (subscripts denote atomic percent):

$$Ni_{(100-a-b-c-d-e)}Cr_aMo_bSi_cB_dP_e$$

where:
a is between 3.5 and 6,
b is up to 2,
c is between 4.5 and 7,
d is between 10.5 and 13, and
e is between 4 and 6.

In yet another aspect, the Ni-based alloy has a composition according to the following formula (subscripts denote atomic percent):

$$Ni_{(100-a-b-c-d-e)}Cr_aMo_bSi_cB_dP_e \quad (14)$$

where:
a is between 3 and 8,
b is up to 2,
c is between 10 and 14,
d is between 9 and 13, and
e is up to 8.

In yet another aspect, the Ni-based alloy has a composition according to the following formula (subscripts denote atomic percent):

$$Ni_{(100-a-b-c-d-e)}Mo_aNb_bMn_cP_dB_e \quad (15)$$

where:
a is between 2 and 12,
b is up to 8,
c is up to 2,
d is between 14 and 19, and
e is between 1 and 4.

In yet another aspect, the Ni-based alloy has a composition according to the following formula (subscripts denote atomic percent):

$$Ni_{(100-a-b-c)}Mn_aX_bP_{c-d}B_d \quad (16)$$

where:
a is between 0.5 and 10,
b is up to 15,
c is between 14 and 24,
d is between 1 and 8, and
wherein X can be Cr and/or Mo.

In yet another aspect, the Ni-based alloy has a composition according to the following formula (subscripts denote atomic percent):

$$Ni_{(100-a-b-c-d)}Cr_aNb_bP_cSi_d \quad (17)$$

where:
a is between 2 and 18,
b is between 1 and 6,
c is between 16 and 20, and
d is up to 4.

In yet another aspect, the Ni-based alloy has a composition according to the following formula (subscripts denote atomic percent):

$$Ni_{(100-a-b-c-d-e)}Co_aCr_bNb_cP_dB_e \quad (18)$$

where:
a ranges from 0.5 to 30,
b ranges from 2 to 15,
c ranges from 1 to 5,
d ranges from 14 to 19, and
e ranges from 1 to 5.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure.

DETAILED DESCRIPTION

Figure 1:
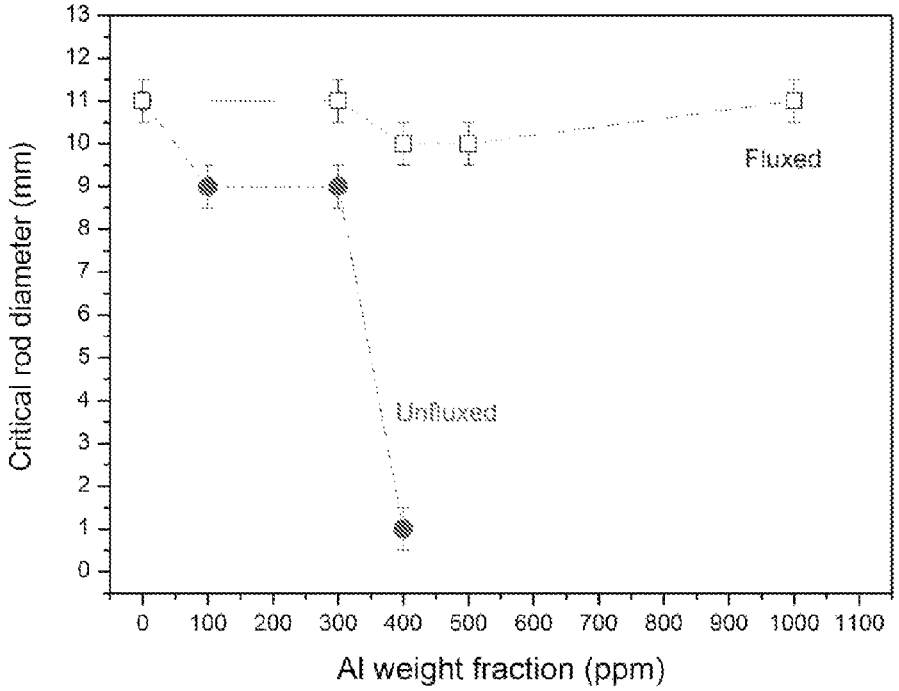
FIG. 1 provides a plot showing the effect of aluminum impurity at levels ranging between 0 and 1000 ppm on the glass forming ability of fluxed and unfluxed $Ni_{71.4}Cr_{5.5}Nb_{3.4}P_{16.7}B_3$ alloy.

The present disclosure is directed to methods of fluxing Ni-based glass-forming alloys contaminated with Al impurities in order to reduce the Al impurities from the alloy and reverse its adverse effects on glass-forming ability and toughness. Ni-based alloys capable of forming bulk metallic glass with critical rod diameters of 3 mm or greater and exhibiting relatively high notch toughness up to nearly 100 MPa $m^{1/2}$ have been disclosed in recent patent applications. For example, U.S. patent application Ser. No. 13/592,095, entitled "Bulk Nickel-Based Chromium and Phosphorous Bearing Metallic Glasses", filed on Aug. 22, 2012, and U.S. patent application Ser. No. 14/067,521, entitled "Bulk Nickel-Based Chromium and Phosphorous Bearing Metallic Glasses with High Toughness", filed on Oct. 30, 2013, disclose Ni—Cr—Nb—P—B metallic glasses. Also, U.S. patent application Ser. No. 14/081,622, entitled "Bulk Nickel-Phosphorus-Boron Glasses bearing Chromium and Tantalum", filed on Nov. 15, 2013, discloses Ni—Cr—Ta—P—B metallic glasses. Each of foregoing applications is incorporated herein by reference in its entirety.

When these nickel-based alloys are commercially produced, they may contain some raw elements that likely have been aluminothermically refined, and thus would be contaminated with aluminum. The aluminum impurities may combine with oxygen as well as other impurities to form alumina-based inclusions, which may adversely influence the glass-forming ability of the nickel-based alloys. Moreover, the inclusions may compromise the mechanical properties of metallic glass articles produced from the nickel-based alloys, particularly their toughness.

In one embodiment, the Ni-based alloy has a composition according to the following formula (subscripts denote atomic percent):

$$Ni_{100-a-b}X_aY_b \quad (1)$$

where:

X is Cr, Mo, Mn, Nb, Ta, Fe or combinations thereof

Y is P, B, Si, or combinations thereof a is between 5 and 25 at % b is between 15 and 25 at %

In yet another embodiment, up to 25 at % of X can be substituted with Co. In yet another embodiment, up to 23 at % of X is can be substituted with Co, as described in U.S. Provisional Application No. 61/920,362, entitled "Bulk Nickel-Cobalt-Based Glasses Bearing Chromium, Niobium, Phosphorus And Boron," filed Dec. 23, 2013, the disclosure of which is incorporated herein by reference in its entirety.

In yet another embodiment, a is between 5 and 15 at % and b is between 19 and 23 at %.

In yet another embodiment, the Ni-based alloy has a composition according to the following formula (subscripts denote atomic percent)

$$Ni_{(100-a-b-c-d)}Mn_aX_bP_cB_d \quad (2)$$

where:

a is up to 15, b is between 0.5 and 10, c is between 12 and 21, d is between 1 and 6, a+b is between 5 and 25, c+d is between 15 and 25, and wherein X is at least one of Nb and Ta.

In yet another embodiment, the Ni-based alloy has a composition according to the following formula (subscripts denote atomic percent):

$$Ni_{(100-a-b-c-d)}Mn_aNb_bP_cB_d \quad (3)$$

where:

a is up to 8, b is between 1 and 5, c is between 15 and 18, d is between 1 and 5, a+b is between 5 and 13, and c+d is between 16 and 23, as descripted in U.S. Provisional Patent Application No. 61/866,743, entitled "Bulk Nickel-Phosphorus-Boron Glasses Bearing Manganese and Niobium," filed on Aug. 16, 2013, the disclosure of which is incorporated herein by reference in its entirety.

In yet another embodiment, the Ni-based alloy has a composition according to the following formula (subscripts denote atomic percent):

$$Ni_{(100-a-b-c)}Mn_aX_bP_{c-d}B_d \quad (4)$$

where:

a is between 0.5 and 10 b is up to 15 c is between 14 and 24 d is between 1 and 8 wherein X can be Cr and/or Mo.

In another aspect, the Ni-based alloy has a composition according to the following formula (subscripts denote atomic percent):

$$Ni_{(100-a-b1-b2-c-c1)}Mn_aCr_{b1}Mo_{b2}P_cB_d \quad (5)$$

where:

a is between 1 and 5 b1 is between 4 and 11 b2 is up to 3 c is between 15 and 19 d is between 1 and 5.

In another aspect, the Ni-based alloy has a composition according to the following formula (subscripts denote atomic percent):

$$Ni_{(100-a-b-c-d)}Cr_aNb_bP_cB_d \quad (6)$$

where:

a ranges from 2.5 to 15, b ranges from 1 to 5.5, c ranges from 14.5 to 18.5, and d ranges from 1.5 to 6.5.

In yet another embodiment, the Ni-based alloy has a composition according to the following formula (subscripts denote atomic percent):

$$Ni_{(100-a-b-c-d)}Cr_aNb_bP_cB_d \quad (7)$$

where:

a ranges from 3 to 13, b is determined by x−y*a, where x ranges from 3.8 to 4.2 and y ranges from 0.11 to 0.14, c ranges from 16.25 to 17, d ranges from 2.75 to 3.5, a+b is between 6.91 to 17.34, and c+d is between 19 to 20.5, as described in U.S. Provisional patent application Ser. No. 14/067,521, entitled "Bulk Nickel-Based Chromium and Phosphorus Metallic Glasses with High Toughness," filed on Oct. 30, 2013, which is incorporated herein by reference in its entirety.

In yet another embodiment, the Ni-based alloy has a composition according to the following formula (subscripts denote atomic percent):

$$Ni_{(100-a-b-c-d)}Cr_aNb_bP_cB_d \quad (8)$$

where:

a ranges from 7 to 11, b ranges from 1 to 3.25, c ranges from 13 to 16, d ranges from 3 to 6.5, a+b is between 8 to 14.25, and c+d is between 16 to 22.5, as described in U.S. Provisional Patent Application No. 61/944,197, entitled "Bulk Nickel-Chromium-Phosphorus Glasses Bearing Niobium and Boron Exhibiting High Strength and/or High Thermal Stability of the Supercooled Liquid," filed on Feb. 25, 2014, which is incorporated herein by reference in its entirety.

In yet another embodiment, the Ni-based alloy has a composition according to the following formula (subscripts denote atomic percent):

$$Ni_{(100-a-b-c-d)}Cr_aTa_bP_cB_d \quad (9)$$

where:

a is between 3 and 11, b is between 1.75 and 4, c is between 14 and 17.5, d is between 2.5 and 5, a+b is between 5 and 15, and c+d is between 16.5 and 22.5, as described in U.S. Provisional patent application Ser. No. 14/081,622, entitled "Bulk Nickel-Phosphorus-Boron Glasses Bearing Chromium and Tantalum," filed on Nov. 15, 2013, which is incorporated herein by reference in its entirety.

In yet another embodiment, the Ni-based alloy has a composition according to the following formula (subscripts denote atomic percent):

$$Ni_{(100-a-b-c)}Mn_aX_bP_{c-d}Si_d \quad (10)$$

where:
a is between 0.5 and 10,
b is up to 15,
c is between 16 and 24,
d is between 0.25 and 5,
a+b is between 5 and 25,
c+d is between 16.25 and 29, and
wherein X can be at least one of Cr, Mo, Nb, Ta, as described in U.S. Provisional Patent Application No. 61/913,684, entitled "Bulk Nickel-Phosphorus-Silicon Glasses Bearing Manganese," filed Dec. 9, 2013, which is incorporated by reference in its entirety.

In yet another embodiment, the Ni-based alloy has a composition according to the following formula (subscripts denote atomic percent):

$$Ni_{(100-a-b-c)}Mn_aX_bP_cSi_d \quad (11)$$

where:
a is between 0.25 and 12
b is up to 15
c is between 14 and 22
d is between 0.25 and 5
wherein X can be at least one of Cr, Mo, Nb, Ta.

In yet another embodiment, the Ni-based alloy has a composition according to the following formula (subscripts denote atomic percent):

$$Ni_{(100-a-b-c)}Fe_aSi_bB_c \quad (12)$$

where:
a is between 5 and 25,
b is between 10 and 14,
c is between 9 and 13, and
b+c is between 19 and 25, as described in as described in U.S. patent application Ser. No. 14/029,719, entitled "Bulk Nickel-Silicon-Boron Glasses Bearing Chromium," filed Sep. 17, 2013, which is incorporated by reference in its entirety.

In yet another embodiment, the Ni-based alloy has a composition according to the following formula (subscripts denote atomic percent):

$$Ni_{(100-a-b-c)}Fe_aSi_bB_cP_d \quad (13)$$

where:
a is between 5 and 25
b is between 7 and 10
c is between 7 and 10
d is between up tp8, and
b+c+d is between 15 and 25, as described in U.S. patent application Ser. No. 14/029,719, entitled "Bulk Nickel-Silicon-Boron Glasses Bearing Chromium," filed Sep. 17, 2013, which is incorporated by reference in its entirety. In yet another aspect, the Ni-based alloy has a composition according to the following formula (subscripts denote atomic percent):

$$Ni_{(100-a-b-c-d-e)}Cr_aMo_bSi_cB_dP_e \quad (14)$$

where:
a is between 3 and 8,
b is up to 2,
c is between 10 and 14,
d is between 9 and 13, and
e is up to 8.

In yet another aspect, the Ni-based alloy has a composition according to the following formula (subscripts denote atomic percent):

$$Ni_{(100-a-b-c-d-e)}Mo_aNb_bMn_cP_dB_e \quad (15)$$

where:
a is between 2 and 12,
b is up to 8,
c is up to 2,
d is between 14 and 19, and
e is between 1 and 4.

In yet another aspect, the Ni-based alloy has a composition according to the following formula (subscripts denote atomic percent):

$$Ni_{(100-a-b-c)}Mn_aX_bP_{c-d}B_d \quad (16)$$

where:
a is between 0.5 and 10,
b is up to 15,
c is between 14 and 24,
d is between 1 and 8, and
wherein X can be Cr and/or Mo.

In yet another aspect, the Ni-based alloy has a composition according to the following formula (subscripts denote atomic percent):

$$Ni_{(100-a-b-c-d)}Cr_aNb_bP_cSi_d \quad (17)$$

where:
a is between 2 and 18,
b is between 1 and 6,
c is between 16 and 20, and
d is up to 4.

In yet another embodiment, the Ni-based alloy has a composition according to the following formula (subscripts denote atomic percent):

$$Ni_{(100-a-b-c-d-e)}Co_aCr_bNb_cP_dB_e \quad (18)$$

where:
a ranges from 0.5 to 30,
b ranges from 2 to 15,
c ranges from 1 to 5,
d ranges from 14 to 19,
e ranges from 1 to 5,
b+c is between 5 and 20, and
d+e is between 15 and 24, as described in U.S. Provisional Patent Application No. 61/920,362, entitled "Bulk Nickel-Cobalt-Based Glasses Bearing Chromium, Niobium, Phosphorus and Boron," filed on Dec. 23, 2013, which is incorporated herein by reference in its entirety.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure.

Definitions

In the present disclosure, the term "high-purity state" of the alloy is referred to herein as the state achieved by creating the alloy using high-purity elements in the absence of any flux. Alloys in their "high-purity state" are generally more expensive than alloys contaminated with more impurities. The total aluminum impurity in an alloy in the "high-purity-state", as defined herein, is equal to or less than 10 ppm.

In the present disclosure, the term "entirely free" of an element means not more than trace amounts of the element found in naturally occurring trace amounts.

In the present disclosure, the glass-forming ability of each alloy can be quantified by the "critical rod diameter", defined as largest rod diameter in which the amorphous phase (i.e. the metallic glass) can be formed when processed by the method of water quenching a quartz tube with 0.5 mm thick wall containing a molten alloy.

The "notch toughness," defined as the stress intensity factor at crack initiation $K_q$ when measured on a 3 mm diameter rod containing a notch with length ranging from 1 to 2 mm and root radius ranging from 0.1 to 0.15 mm, is the measure of the material's ability to resist fracture in the presence of a notch. The notch toughness is a measure of the work required to propagate a crack originating from a notch. A high $K_q$ ensures that the material will be tough in the presence of defects.

The present method is applicable to any Ni-based glass-forming alloy, including but not limited to, Ni—Cr—Nb—P—B, Ni—Cr—Ta—P—B, Ni—Cr—Mn—P—B, Ni—Nb—P—B, Ni—Mn—Ta—P—C, Ni—Mo—Nb—Mn—P—B, Ni—Mn—Nb—P—B, Ni—CR—Si—B, Ni—Cr—Mo—Si—B—P, Ni—Fe—Si—B—P and Ni—Mn—P—Si.

Specifically, an alloy of a Ni-based glass-forming alloy containing aluminum as an impurity, which can have an atomic concentration between 100 ppm and 10000 ppm, is fluxed with a molten chemical agent based on boron and oxygen at a temperature high enough for a sufficient time such that the alloy can demonstrate glass forming ability and toughness that is about equal to those of a high purity alloy, which contains Al as an impurity at atomic concentrations of less than 10 ppm. The term "ppm" in this disclosure is used to denote a weight fraction in "parts per million".

Description of the Effects of the Fluxing Method on Sample Alloys

To demonstrate the effects of the present fluxing method in reducing the aluminum impurity and mitigating its adverse effects on glass forming ability and toughness, Ni—Cr—Nb—P—B alloys, disclosed in a recent application (U.S. patent application Ser. No. 14/067,521, entitled "Bulk Nickel-Based Chromium and Phosphorous Bearing Metallic Glasses with High Toughness", filed on Oct. 30, 2013, which is incorporated herein by reference), are used. Specifically, alloy $Ni_{71.4}Cr_{5.5}Nb_{3.4}P_{16.7}B_3$ is used as an example alloy.

When $Ni_{71.4}Cr_{5.5}Nb_{3.4}P_{16.7}B_3$ in its high-purity state is processed by quartz-tube water-quenching, and the melt has been heated to 1250° C. or higher, the alloy is capable of forming amorphous rods having a critical rod diameter of 11 mm. When an alloy in its high purity state is contaminated with aluminum by adding between 100 and 10000 ppm high-purity aluminum to the alloy, the glass forming ability of the contaminated alloy is severely degraded. Specifically, the critical rod diameter decreases dramatically from 11 mm, corresponding to an alloy in the high purity state, to 1 mm for the alloy containing 400 ppm of aluminum impurity. The glass forming ability of alloys containing between 400 and 1000 ppm of aluminum impurity was not feasible to assess with the quartz-tube water-quench method, but is expected to be significantly less than 1 mm.

When the aluminum-contaminated Ni-based alloys are fluxed with boron oxide according to the present method, the adverse effects of aluminum on glass forming ability are significantly decreased, as the glass-forming ability of the fluxed alloy resembles that of the high-purity state of the alloy. Specifically, when Ni-based alloys with aluminum impurity levels ranging from 100 to 1000 ppm are fluxed according to the current method, the critical rod diameter of the fluxed alloy is between 10 and 11 mm throughout the entire ppm range of the impurity, that is, almost unchanged as compared to the alloy in the high-purity state. This data is listed in Table 1, and plotted graphically in FIG. 1.

TABLE 1

Effect of aluminum impurity on the glass forming ability of alloy $Ni_{71.4}Cr_{5.5}Nb_{3.4}P_{16.7}B_3$.

| Aluminum weight fraction | Fluxing | Critical Rod Diameter [mm] |
|---|---|---|
| <10 ppm Al | Unfluxed | 11 |
| | Fluxed | 11 |
| 100 ppm Al | Unfluxed | 9 |
| | Fluxed | — |
| 300 ppm Al | Unfluxed | 9 |
| | Fluxed | 11 |
| 400 ppm Al | Unfluxed | 1 |
| | Fluxed | 10 |
| 500 ppm Al | Unfluxed | <1 |
| | Fluxed | 10 |
| 1000 ppm Al | Unfluxed | <1 |
| | Fluxed | 11 |

As shown, when a sample $Ni_{71.4}Cr_{5.5}Nb_{3.4}P_{16.7}B_3$ alloy with Al impurities of 400 ppm is fluxed according the present disclosure, the critical rod diameter of the fluxed alloy increases tenfold from less than 1 mm to 10 mm. A similar tenfold increase was also observed for samples of $Ni_{71.4}Cr_{5.5}Nb_{3.4}P_{16.7}B_3$ alloy with Al impurities of 500 ppm and 1000 ppm.

The present fluxing method also increases the notch toughness of samples of $Ni_{71.4}Cr_{5.5}Nb_{3.4}P_{16.7}B_3$ metallic glass. When the Al-contaminated alloys were fluxed with boron oxide according to the present method, the adverse effects of aluminum impurity on toughness are to a large extent reversed, as the notch toughness improves attaining values closer to that of the metallic glass formed from the alloy in a high-purity state. Specifically, when alloys with aluminum impurity levels ranging from 100 to 1000 ppm are fluxed according to the present method, the notch toughness of the metallic glass formed from the alloys after fluxing is between 65 and 95 MPa $m^{1/2}$ throughout the entire ppm range of the impurity.

A 3-mm diameter metallic glass rod of $Ni_{71.4}Cr_{5.64}Nb_{3.46}P_{16.5}B_3$ in a high-purity state, processed by quartz-tube water-quenching after the melt has been heated to 1250° C. exhibits a notch toughness of 99 MPa $m^{1/2}$. When the $Ni_{71.4}Cr_{5.5}Nb_{3.4}P_{16.7}B_3$ alloy in the high purity state is contaminated with aluminum by adding between 100 and 500 ppm high-purity aluminum to the alloy, the notch toughness of the metallic glass formed from the contaminated alloy is severely degraded. For example, a notch toughness of 65 MPa $m^{1/2}$ was observed for $Ni_{71.4}Cr_{5.5}Nb_{3.4}P_{16.7}B_3$ metallic glass with aluminum impurities of 100 ppm. Specifically, the notch toughness drops precipitously from 99 MPa $m^{1/2}$, corresponding to a metallic glass formed from an alloy in the high purity state, to 38

Figure 2:
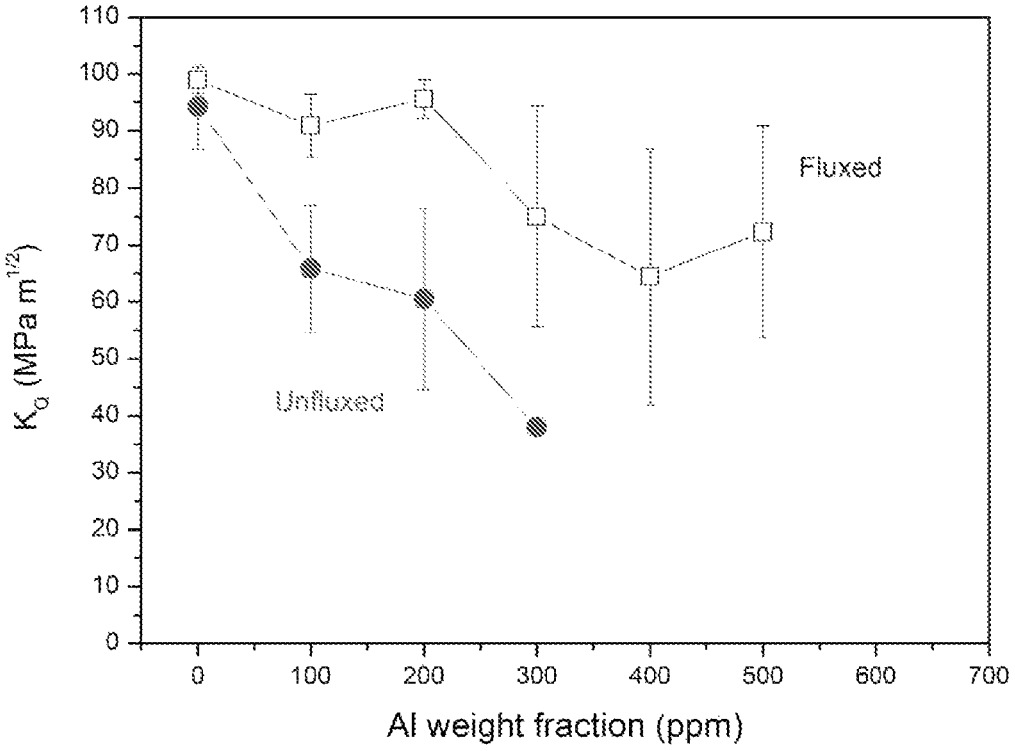
FIG. 2 provides a plot showing the effect of aluminum impurity at levels ranging between 0 and 500 ppm on the notch toughness of fluxed and unfluxed sample $Ni_{71.4}Cr_{5.5}Nb_{3.4}P_{16.7}B_3$ metallic glass.

MPa $m^{1/2}$ for the metallic glass formed from the alloy containing 300 ppm of aluminum impurity. The notch toughness of the metallic glass formed from the alloys containing between 300 and 500 ppm of aluminum impurity was not feasible to assess, as these alloys are incapable of forming 3 mm amorphous rods with the quartz-tube water-quench method. Nevertheless, the notch toughness of these metallic glass formed from the contaminated alloys is expected to be less than 38 MPa $m^{1/2}$. This data is listed in Table 2, and plotted graphically in FIG. 2.

TABLE 2

Effect of aluminum impurity on the notch toughness of metallic glass $Ni_{71.4}Cr_{5.5}Nb_{3.4}P_{16.7}B_3$.

| Aluminum weight fraction | Fluxing | Notch Toughness, $K_Q$ (MPa $m^{1/2}$) |
|---|---|---|
| <10 ppm Al | Unfluxed | 94.3 ± 7.4 |
| | Fluxed | 98.9 ± 2.3 |
| 100 ppm Al | Unfluxed | 65.8 ± 11.2 |
| | Fluxed | 90.9 ± 5.5 |
| 200 ppm Al | Unfluxed | 60.5 ± 15.9 |
| | Fluxed | 95.6 ± 3.4 |
| 300 ppm Al | Unfluxed | 38.0 ± 1.0 |
| | Fluxed | 75.0 ± 19.4 |
| 400 ppm Al | Unfluxed | — |
| | Fluxed | 64.4 ± 22.5 |
| 500 ppm Al | Unfluxed | — |
| | Fluxed | 72.3 ± 18.6 |

Lastly, differential scanning calorimetry was performed at a scanning rate of 20° C./min for metallic glasses formed from (i) an alloy in its high-purity state, (ii) an alloy containing 400 ppm aluminum impurity, and (iii) an alloy containing 400 ppm aluminum impurity and subsequently fluxed according to the present method. Table 3 shows data for the glass-transition temperature $T_g$, crystallization temperature $T_x$, solidus temperature $T_s$, and liquidus temperature $T_l$. The scanning curves are presented in FIG. 3, arrows from left to right designate $T_g$, $T_x$, $T_s$, and $T_l$, respectively.

Figure 3:
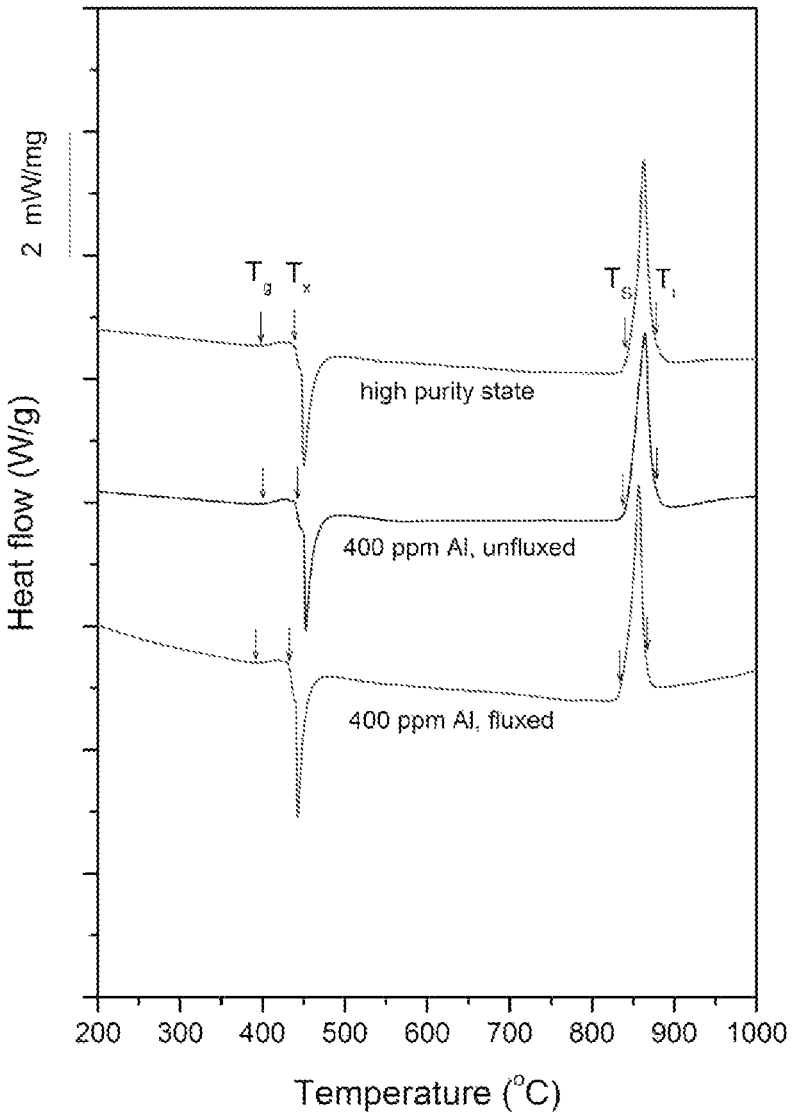
FIG. 3 provides a plot showing calorimetry scans at a heating rate of 20° C./min of sample $Ni_{71.4}Cr_{5.5}Nb_{3.4}P_{16.7}B_3$ metallic glass in the high-purity state, after being contaminated with 400 ppm Al, and after being contaminated with 400 ppm Al and subsequently fluxed according the present fluxing method.

As shown in FIG. 3 and Table 3, $T_g$, $T_x$, $T_s$, and $T_l$ of the metallic glass formed from an alloy contaminated with 400 ppm of aluminum are not significantly different compared to those of the metallic glass formed from an alloy in the high purity state. On the other hand, $T_g$, $T_x$, $T_s$, and $T_l$ of the metallic glass formed from an alloy contaminated with 400 ppm of aluminum but subsequently fluxed according to the present method are shifted down by about 6-9° C. as compared to those of the metallic glasses formed from the alloy in the high purity state and from the contaminated unfluxed alloy.

TABLE 3

Effect of aluminum impurity on the glass-transition, crystallization, solidus, and liquidus temperatures of metallic glass $Ni_{71.4}Cr_{5.5}Nb_{3.4}P_{16.7}B_3$.

| Aluminum weight fraction | Fluxing | $T_g$ (° C.) | $T_x$ (° C.) | $T_s$ (° C.) | $T_l$ (° C.) |
|---|---|---|---|---|---|
| <10 ppm Al | Unfluxed | 398 | 439 | 840 | 876 |
| 400 ppm Al | Unfluxed | 398 | 440 | 840 | 875 |
| | Fluxed | 392 | 432 | 834 | 866 |

Description of Methods

The method used to produce the example alloys involves inductive melting of the appropriate amounts of elemental constituents in a fused silica crucible under inert atmosphere. The purity levels of the constituent elements used to create the high-purity state in the example alloys were as follows: Ni 99.995% (0.05 ppm Al), Cr 99.996% (0 ppm Al), Nb 99.95% (0 ppm Al), B 99.5% (0.032 atomic percent Al), and P 99.9999% (0 ppm Al). The total weight fraction of the aluminum impurity in the high-purity state of the alloy is 4.84 ppm. To incorporate the Al impurity at a particular ppm level in the example alloys, the appropriate amount of high purity aluminum (Al 99.999%) was added to the rest of the elements that make up the high-purity state.

The fluxing method used to flux the example Al-contaminated alloys involves melting the alloys and a fluxing agent (e.g. boron oxide) in a quartz tube under inert atmosphere, bringing the alloy melt in contact with the fluxing agent melt (e.g. boron oxide melt) and allowing the two melts to interact for a sufficient time at a high temperature, such as 1200° C., and subsequently quenching in a bath of room temperature water.

In some embodiments, the fluxing temperature may range from about 1150° C. to about 1400° C. In some embodiments, the sufficient time for the melts to interact may be at least 500 s. In other embodiments, the time for the melts to interact may be at least 1000 s. In other embodiments, the time for the melts to interact may be at least 1500 s. As described herein, "room temperature" is a temperature between approximately 10° C. and 40° C. I The method used to process the example alloys into glassy rods involves re-melting the alloys (fluxed or unfluxed) in quartz tubes having 0.5 mm thick walls in a furnace under an inert atmosphere, such as high purity argon. After heating the melt to a temperature of about 1100° C. or higher, and particularly between 1200° C. and 1400° C., the melt is rapidly quenching in liquid bath, such as a room-temperature water bath.

Measurement of the notch toughness was performed on 3-mm diameter amorphous rods formed from the example alloys. The amorphous rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure. The following claims are intended to cover all generic and specific features described herein, as well as all statements of the scope of the present method and system, which, as a matter of language, might be said to fall therebetween.

What is claimed is:

1. A method of fluxing a Ni-based glass-forming alloy that contains an initial aluminum impurity, comprising:

heating the Ni-based glass-forming alloy with a fluxing agent based on boron and oxygen to a fluxing temperature that is at least 100° C. above the liquidus temperature of the alloy;

allowing the alloy and the fluxing agent to interact while in contact at the fluxing temperature to form a fluxed melt; and cooling the fluxed melt to a room temperature to form a fluxed alloy with a final aluminum impurity lower than the initial aluminum impurity, wherein the initial aluminum impurity has a weight fraction of greater than 10 ppm.

2. The method of claim 1, wherein the fluxed alloy has critical rod diameter that is at least 70% of the critical rod diameter of the Ni-based glass-forming alloy in a high purity state where an initial aluminum impurity has a weight fraction equal to or less than 10 ppm.

3. The method of claim 1, wherein a metallic glass formed from the fluxed alloy has notch toughness that is at least 70% of the notch toughness of the metallic glass formed from the Ni-based glass-forming alloy in a high purity state where an initial aluminum impurity has a weight fraction equal to or less than 10 ppm.

4. The method of claim 1, wherein the fluxing agent is boron oxide ($B_2O_3$).

5. The method of claim 1, wherein the fluxing agent is boric acid ($H_3BO_3$).

6. The method of claim 1, wherein the fluxing agent has purity of at least 98%.

7. The method of claim 1, wherein the cooling of the fluxed alloy is sufficiently fast such that the alloy solidifies in an amorphous phase.

8. The method of claim 1, wherein the initial aluminum impurity has an atomic fraction ranging between 100 ppm and 10000 ppm.

9. The method of claim 8, wherein the final aluminum impurity has a weight fraction of less than 100 ppm.

10. The method of claim 8, wherein the final aluminum impurity has a weight fraction of less than 50 ppm.

11. The method of claim 1, wherein the final aluminum impurity has a weight fraction of less than 10 ppm.

12. The method of claim 1, wherein the final aluminum impurity has a weight fraction of less than 5 ppm.

13. The method of claim 1, wherein allowing the alloy and the fluxing agent to interact is performed in an inert atmosphere.

14. The method of claim 1, wherein the fluxing temperature is at least 1100° C.

15. The method of claim 1, wherein the fluxing temperature is at least 1200° C.

16. The method of claim 1, wherein the two melts are allowed to interact at the fluxing temperature for at least 500 s.

17. The method of claim 1, wherein the two melts are allowed to interact at the fluxing temperature for at least 1000 s.

18. The method of claim 1, the two melts are allowed to interact at the fluxing temperature for at least 1500 s.

* * * * *